US010689907B2

(12) United States Patent
Hume

(10) Patent No.: US 10,689,907 B2
(45) Date of Patent: Jun. 23, 2020

(54) SELF LEVELING STEP LADDER

(71) Applicant: David J Hume, Kailua-Kona, HI (US)

(72) Inventor: David J Hume, Kailua-Kona, HI (US)

( * ) Notice: Subject to any disclaimer, the term of this patent is extended or adjusted under 35 U.S.C. 154(b) by 0 days.

(21) Appl. No.: 15/705,598

(22) Filed: Sep. 15, 2017

(65) Prior Publication Data

US 2018/0002984 A1 Jan. 4, 2018

Related U.S. Application Data

(63) Continuation of application No. 14/477,835, filed on Sep. 4, 2014, now abandoned.

(60) Provisional application No. 61/959,848, filed on Sep. 4, 2013.

(51) Int. Cl.

| | |
|---|---|
| ***E06C 7/50*** | (2006.01) |
| ***E06C 7/44*** | (2006.01) |
| ***E06C 1/18*** | (2006.01) |
| ***E06C 1/20*** | (2006.01) |

(52) U.S. Cl.

CPC ..... *E06C 7/44* (2013.01); *E06C 1/18* (2013.01); *E06C 1/20* (2013.01); *E06C 7/50* (2013.01)

(58) Field of Classification Search

CPC ..... E06C 1/14; E06C 1/16; E06C 1/18; E06C 7/50; E06C 7/423

See application file for complete search history.

(56) References Cited

U.S. PATENT DOCUMENTS

| | | | | | |
|---|---|---|---|---|---|
| 341,535 | A * | 5/1886 | Wright | E06C 1/20 | 182/171 |
| 785,277 | A * | 3/1905 | Smith | E06C 1/20 | 182/169 |
| 1,377,579 | A * | 5/1921 | Hedden | E06C 1/20 | 182/170 |
| 1,471,290 | A * | 10/1923 | Stevens | E06C 1/20 | 182/170 |
| 1,510,461 | A * | 10/1924 | Cordes | E06C 1/38 | 182/104 |
| 1,742,304 | A * | 1/1930 | Briles | E06C 1/20 | 182/170 |
| 1,778,898 | A * | 10/1930 | Konigsberg | E06C 1/20 | 182/124 |
| 1,866,974 | A * | 7/1932 | Hohing | E06C 1/20 | 182/170 |
| 2,567,302 | A * | 9/1951 | Sip | E06C 1/54 | 182/104 |
| 2,868,426 | A * | 1/1959 | Groves | E06C 7/44 | 182/170 |
| 3,165,169 | A * | 1/1965 | Machen | E06C 1/22 | 182/170 |
| 4,244,444 | A * | 1/1981 | Quaggiotto | E06C 1/393 | 182/104 |
| 4,478,549 | A * | 10/1984 | Stelly | B65G 69/30 | 182/104 |

(Continued)

FOREIGN PATENT DOCUMENTS

| | | | | |
|---|---|---|---|---|
| FR | 323411 A | | 3/1903 | |
| FR | 437453 A | * | 4/1912 | E06C 1/18 |
| GB | 660172 A | | 10/1951 | |

*Primary Examiner* — Colleen M Chavchavadze
(74) *Attorney, Agent, or Firm* — Oliff PLC

(57) ABSTRACT

A self leveling stepladder with a universal hinge joint providing many new advantages that traditional a-frame step ladders are not capable to offer.

12 Claims, 5 Drawing Sheets

(56) References Cited

U.S. PATENT DOCUMENTS

| | | | | |
|---|---|---|---|---|
| 4,834,216 | A * | 5/1989 | Wallick, Jr. | E06C 1/16 182/104 |
| 6,874,598 | B1 * | 4/2005 | Baker | E06C 1/38 182/165 |
| 2005/0121261 | A1 * | 6/2005 | Moss | E06C 1/22 182/165 |
| 2009/0000867 | A1 * | 1/2009 | Wang | E06C 1/39 182/104 |

* cited by examiner

SELF LEVELING STEP LADDER

This is a Continuation of application Ser. No. 14/477,835 filed Sep. 4, 2014, which claims the benefit of U.S. Provisional Application No. 61/959,848 filed Sep. 4, 2013. The disclosure of the prior application is hereby incorporated by reference herein in its entirety.

FIELD OF INVENTION

The present invention relates to step ladders and more particularly pertains to an improvement to an A-frame ladder allowing it to be placed on uneven surfaces.

BACKGROUND

Stepladders are free-standing ladders that can be erected without support from a wall, and can be folded together under transport. A stepladder consists of a step frame, which is pivotally attached to a smaller support frame. The step frame includes a number of rungs, or steps. Steps are climbing supports with "walking and/or stepping surfaces" typically ranging anywhere from 8 cm deep to 2-5 cm. The upper step is often a step-plate or platform, enabling a user to stand and move safely and comfortable. The step and support frames are connected by some locking mechanism that prevents the stepladder from collapsing.

SUMMARY OF THE INVENTION

The present invention overcomes a limitation of the prior designs, specifically by providing an easy to use mechanism wherein the stepladder is self-leveling. Whilst similar to conventional stepladders in some respects, the instant invention is able to accommodate uneven ground by virtue of a unique hinge apparatus.

A conventional fold out type stepladder only works well on a flat surface and is very unstable on anything else. In such instances, all of the legs of the ladder fail to touch the surface. In such instances, the conventional stepladder is not stable and not easy to stand upon, when set on uneven ground. For example, a fruit picker's ladder solves part of the problem by only having three legs; two in a step frame and a single leg at the back. They work well when pushed between the branches and foliage of a tree, but are mostly unstable when free standing.

Many inventions have tried to address this problem but they are inadequate at best; most being of the extendable leg type. They are awkward and time consuming to set up, particularly when the ladder has to be moved to many locations as in fruit picking. In accordance with aspects of the present disclosure, the instant self-leveling stepladder with a universal hinge joint provides many new advantages that traditional a-frame step ladders are not capable to deliver.

In the description herein, some details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

BRIEF DESCRIPTION OF THE DRAWINGS

Embodiments of the present disclosure are described herein with reference to the drawings, in which.

The novel features which are characteristic of the invention, as to organization and method of use, together with further objects and advantages thereof, may be better understood from the following brief disclosure considered in connection with the accompanying drawings in which one or more preferred embodiments of the invention are illustrated by way of example. It is to be expressly understood, however, that the drawings are for the purpose of illustration and description only and are not intended as a definition of the limits of the invention.

DETAILED DESCRIPTION

The novelty of this invention revolves around the movement allowed by an unconventional hinge. Its unique design can be applied to almost any type of fold out step ladder. By virtue of the hinge 150, the two sides 100, 200 of a fold-out step ladder 1000 are allowed full movement in all planes. The two sides 100, 200 can open conventionally and also swing from side to side and at angles to each other. Their movement allows all four legs 101, 102, 201, 202 of the ladder 1000 to find contact with uneven ground and provide a stable platform to climb up on.

Figure 1:
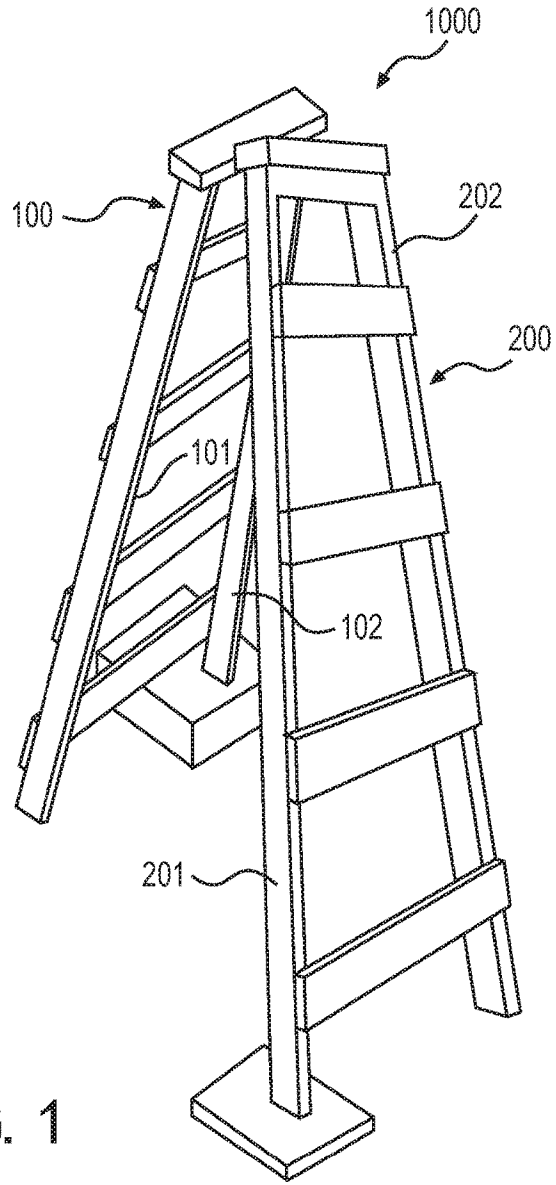
FIG. 1 is a side front perspective drawing image of the self-leveling step ladder self-leveling on uneven ground, in accordance with an embodiment of the instant invention.
Figure 2:
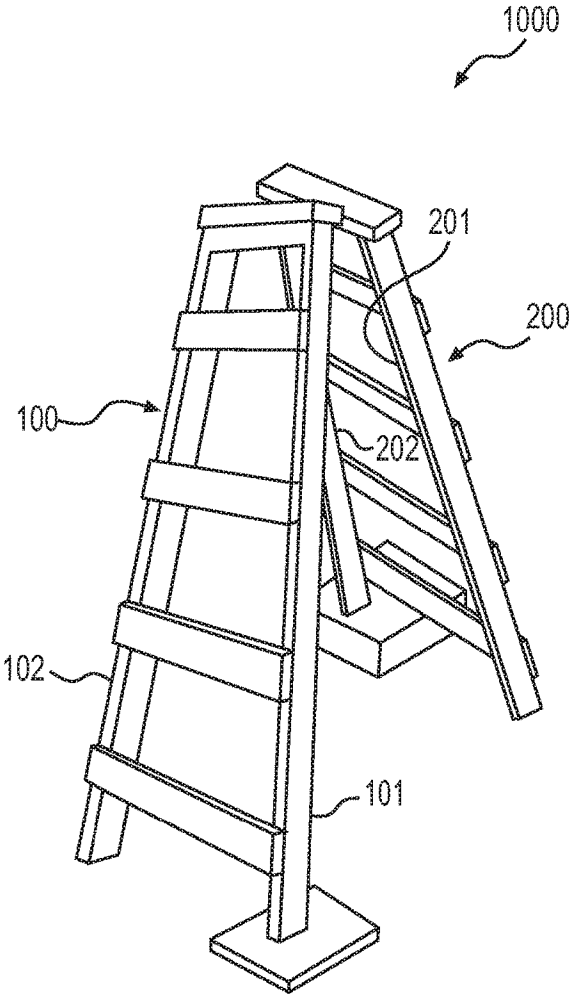
FIG. 2 is a side rear perspective drawing image of the self-leveling step ladder self-leveling on uneven ground, in accordance with an embodiment of the instant invention.
Figure 4:
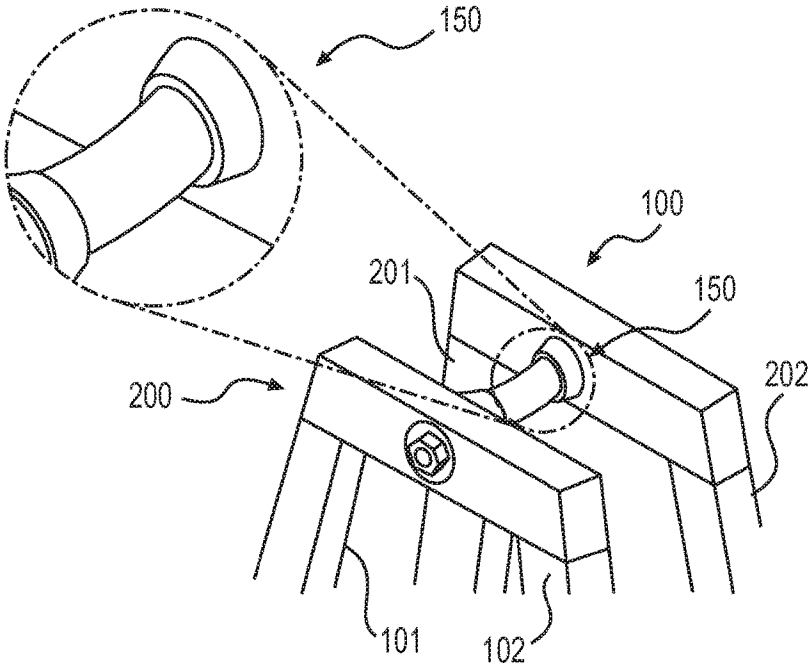
FIG. 4 is an exploded top perspective image of the hinge comprised of a rubber tendon joint as the universal hinge, in accordance with one embodiment of the instant invention.
Figure 3:
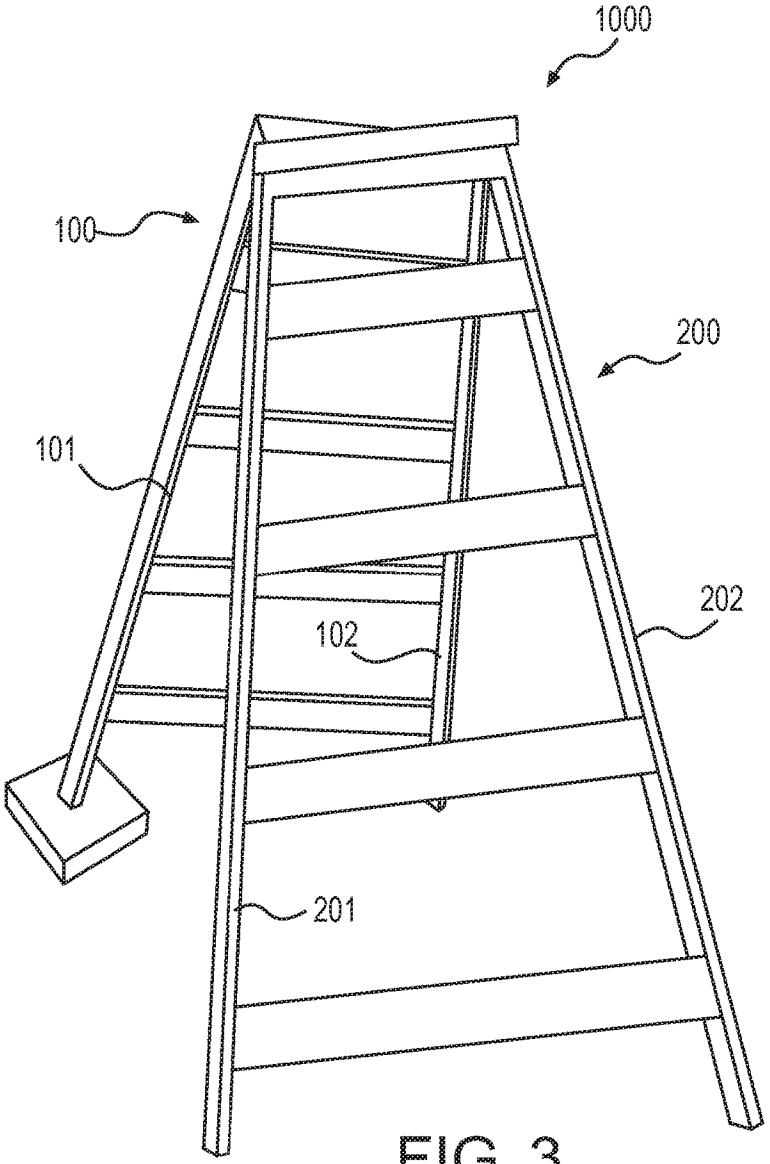
FIG. 3 is a front perspective drawing image of the self-leveling step ladder self-leveling on uneven ground, in accordance with an embodiment of the instant invention.
Figure 5:
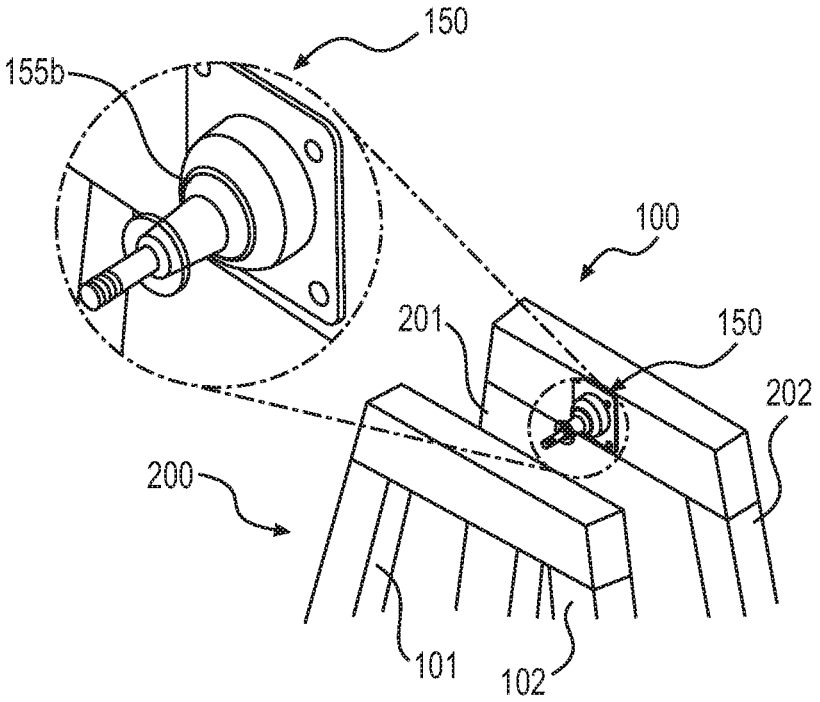
FIG. 5 is an exploded top perspective image of the hinge comprised of a ball and socket joint as the universal hinge, in accordance with another embodiment of the instant invention.
Figure 6:
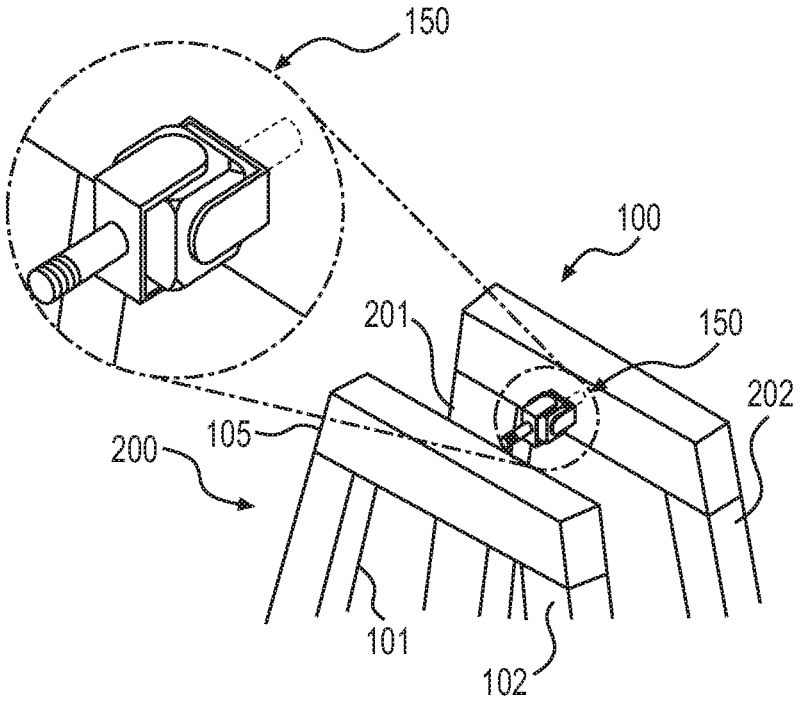
FIG. 6 is an exploded top perspective image of the hinge comprised of a mechanical joint as the universal hinge, in accordance with another embodiment of the instant invention.
Figure 7:
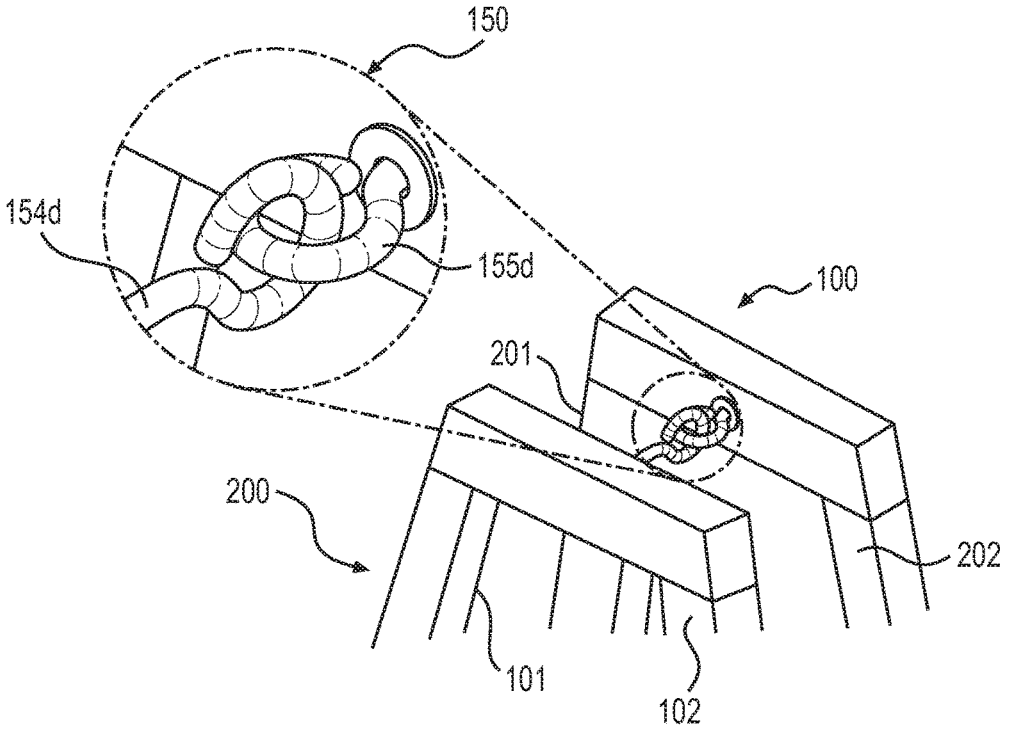
FIG. 7 is an exploded top perspective image of the hinge comprised of a set of interlocking eye joints serving as the universal hinge, in accordance with another embodiment of the instant invention.
Figure 8A:
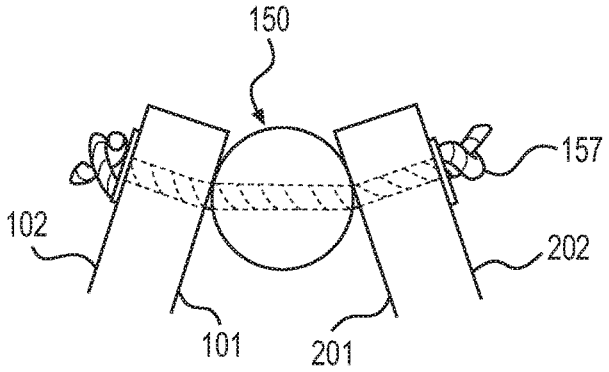
FIGS. 8A and 8B are side and top views of the hinge comprised of a rope threaded ball joint as the universal hinge, in accordance with another embodiment of the instant invention.
Figure 8B:
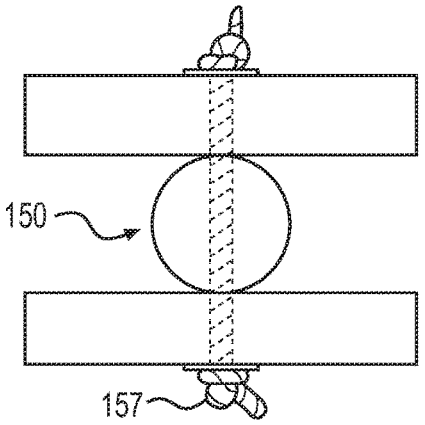
Figure 9:
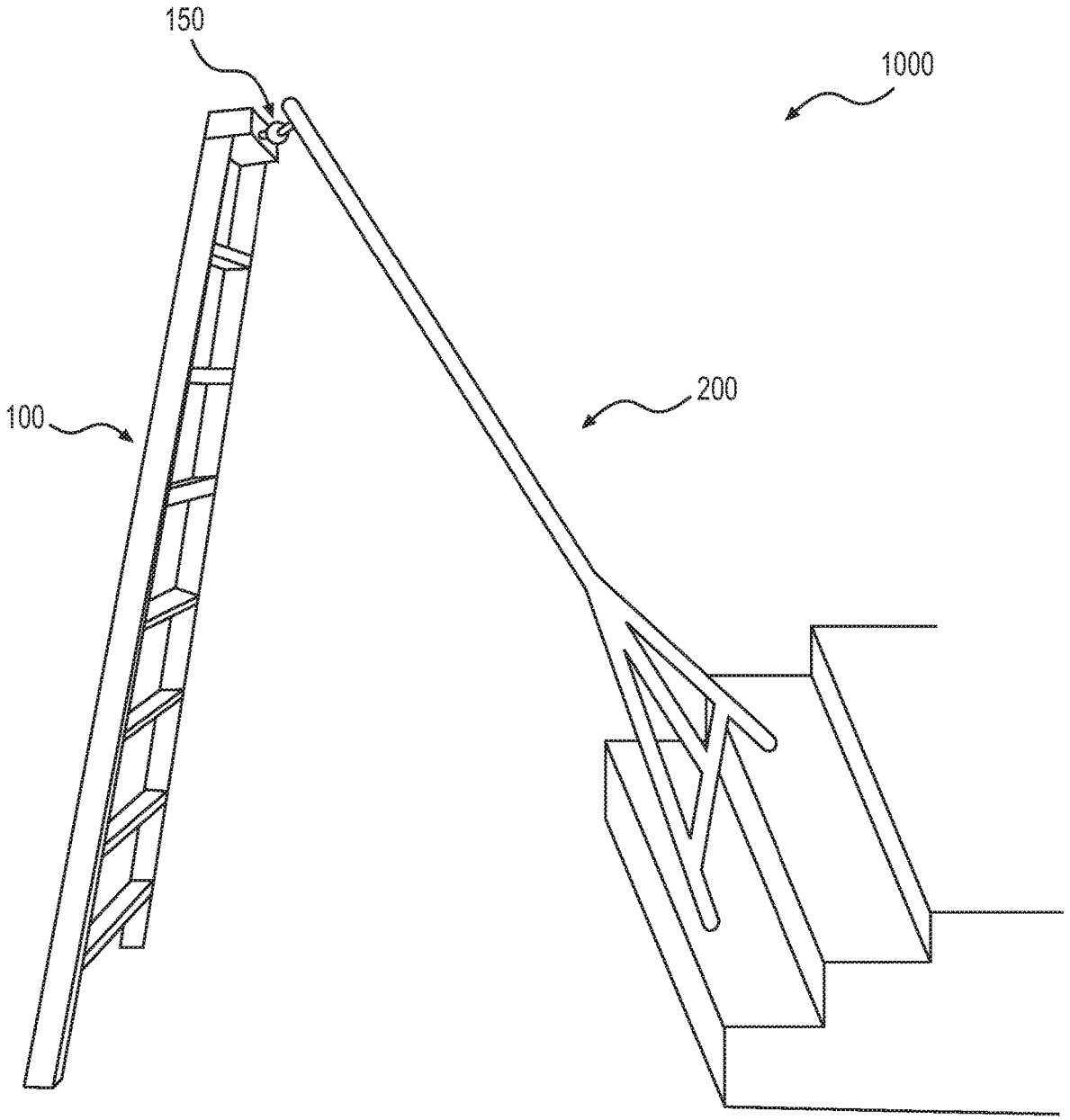
FIG. 9 is an alternate embodiment illustrating a Y-shaped frame side, in accordance with another embodiment of the invention.

The universal hinge 150 may be many possible versions, as illustrated in FIGS. 4-8. For example, the universal joint 150 may comprise embodiments as simple as two linked eyes 154*d*, 155*d* (FIG. 7), one on each step frame 100, 200, a piece of rope 157 or cable passing through each frame. Or, alternatively, in another embodiment, a more complex version such as a knuckle style joint 155*b* (FIG. 5), similar to that used in automobile suspension. Whatever way, free movement to both frames 100, 200 will allow for all four legs 101, 102, 201, 202 to be stable on uneven ground.

Although this is a novel universal joint, there is nothing highly technological about the hinge. It could be merely two eye bolts 154*d*, 155*d* linked together or two U-bolts; one attached to either frame 100, 200. It could be as simple as a cable or tendon (FIG. 4) from one side to the other. This design allows the ladder to open conventionally and also allows the frames to move from side to side independent of each other. It is this free movement in all planes that allows for all four legs 101, 102, 201, 202 to contact the uneven ground at the same time. The ladder 1000 very easily and quickly finds a stable position for safe climbing.

The applications and usage are many for the instant invention, ranging from a two or three step utility ladder 1000, to high reaching ladders suitable for fruit picking. The invention will suit any application using a four-legged adjustable ladder on uneven ground. This style of four legged fruit picker ladder is much more stable than the three legged version. All versions allow movement in three planes to allow four-leg contact and engagement with uneven ground. It is to be appreciated that one or more of the elements depicted in the drawings/figures can also be implemented in a more separated or integrated manner, or even removed or rendered as inoperable in certain cases, as is useful in accordance with a particular application. Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth.

For example, the ladder 1000 having a wider base going up to a more triangular pointpicker style—could be made of aluminum and fiberglass sides and round ladder rungs. Various sizes will accommodate all sorts of picking from straddling berries to picking coffee, for example, on mountain sides and all kinds or other fruits up to 16 feet or more. In other examples, configuring the instant invention as a low level two or three step ladder—non wobbly—for garden use, clipping and pruning.

Therefore, many modifications may be made to adapt a particular situation or material to the essential scope and spirit of the present invention. It is intended that the invention not be limited to the particular terms used and/or to the particular embodiment disclosed as the best mode contemplated for carrying out this invention, but that the invention will include any and all embodiments and equivalents falling within the scope of the instant disclosure.

The foregoing description of illustrated embodiments of the present invention, including what is described herein, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

The invention claimed is:

1. A self-leveling ladder apparatus comprising:

a first ladder frame that includes a first uppermost frame cap, positioned at an uppermost end of the first ladder frame, and first and second legs;

a second ladder frame that includes a second uppermost frame cap, positioned at an uppermost end of the second ladder frame, and at least a first leg, the first uppermost frame cap and the second uppermost frame cap being rectangular, the first uppermost frame cap and the second uppermost frame cap having exposed top surfaces; and a joint that couples the first uppermost frame cap to the second uppermost frame cap, the joint comprising a knuckle joint, with ball and shaft secured to the first uppermost frame cap, and a housing configured to receive the ball fixedly secured to the second uppermost frame cap, wherein:

the first uppermost frame cap is configured to move along a different plane than the second uppermost frame cap, a center of the first uppermost frame cap being coupled, by the joint, to a center of the second uppermost frame cap;

the joint is configured to permit movement of the first ladder frame and the second ladder frame in three different axes; and when the self-leveling ladder apparatus is configured in an A-frame configuration, all legs of the self-leveling ladder apparatus are configured to contact uneven ground at least at three different heights simultaneously.

2. The self-leveling ladder apparatus of claim 1, wherein the first ladder frame leg is spaced apart from the second leg along an entire length of the first ladder frame, and a plurality of parallel rungs being supported between the first and second leg of the first ladder frame.

3. The self-leveling ladder apparatus of claim 1, wherein the second ladder frame has a second leg, a plurality of parallel rungs being supported between the first and second leg of the second ladder frame.

4. The self-leveling ladder apparatus of claim 1, wherein the first ladder frame is configured to pivot about the joint along the three different axes.

5. The self-leveling ladder apparatus of claim 1, wherein the first ladder frame is configured to pivot about the joint such that the first ladder frame rotates about an axis that intersects with the joint and extends vertically between the first ladder frame and the second ladder frame.

6. The self-leveling ladder apparatus of claim 1, wherein the first ladder frame moves along a first plane and the second ladder frame moves along a second plane, the first plane intersecting with the second plane.

7. The self-leveling ladder apparatus of claim 1, wherein the first uppermost frame cap is connected to the second uppermost frame cap only at a single point.

8. The self-leveling ladder apparatus of claim 6, wherein a corner of the first uppermost frame cap is configured to move above an opposing corner of the second uppermost frame cap.

9. The self-leveling ladder apparatus of claim 8, wherein the corner of the first uppermost frame cap is configured to move below the opposing corner of the second uppermost frame cap.

10. The self-leveling ladder apparatus of claim 5, wherein a corner of the first uppermost frame cap is capable of contacting an opposing corner of the second uppermost frame cap.

11. The self-leveling ladder apparatus of claim 5, wherein a corner of the first uppermost frame cap is configured to move in a first direction and an opposing corner of the second uppermost frame cap is configured to move in a second direction such that the first direction is opposite the second direction.

12. A self-leveling ladder apparatus comprising:

a first ladder frame that includes a first uppermost frame cap, positioned at an uppermost end of the first ladder frame, and two legs;

a second ladder frame that includes a second uppermost frame cap, positioned at an uppermost end of the second ladder frame, and at least one leg, the first uppermost frame cap and the second uppermost frame cap being rectangular, the first uppermost frame cap and the second uppermost frame cap having exposed top surfaces; and a joint that couples the first uppermost frame cap to the second uppermost frame cap, wherein the joint is a rubber tendon joint, the first uppermost frame cap is configured to move along a different plane than the second uppermost frame cap, a center of the first uppermost frame cap being coupled, by the joint, to a center of the second uppermost frame cap;

the joint is configured to permit movement of the first ladder frame and the second ladder frame in three different axes; and when the self-leveling ladder apparatus is configured in an A-frame configuration, all legs of the self-leveling ladder apparatus are configured to contact uneven ground at least at three different heights simultaneously.

* * * * *